US008251572B2

(12) United States Patent
Kozlowski

(10) Patent No.: US 8,251,572 B2
(45) Date of Patent: Aug. 28, 2012

(54) APPARATUS FOR RELEASING A CUP FROM THE CUP HOLDER OF A FOOD MIXING MACHINE

(75) Inventor: Eugene J. Kozlowski, Medina, OH (US)

(73) Assignee: Vita-Mix Corporation, Cleveland, OH (US)

( * ) Notice: Subject to any disclaimer, the term of this patent is extended or adjusted under 35 U.S.C. 154(b) by 178 days.

(21) Appl. No.: 12/803,514

(22) Filed: Jun. 28, 2010

(65) Prior Publication Data

US 2011/0317513 A1 Dec. 29, 2011

(51) Int. Cl.
*B01F 7/20* (2006.01)

(52) U.S. Cl. ..... 366/197; 366/203; 366/242; 366/244; 366/245; 366/247; 366/249; 366/251; 366/279; 221/13; 221/28; 221/29

(58) Field of Classification Search ..... 366/204, 366/208, 209, 212, 242, 244, 245, 247, 251, 366/279, 285, 286, 197, 203; 221/13, 27–29
See application file for complete search history.

(56) References Cited

U.S. PATENT DOCUMENTS 1,623,353 A 4/1927 McCarthy
6,102,246 A 8/2000 Goulet et al.

FOREIGN PATENT DOCUMENTS

JP 2-144793 6/1990

OTHER PUBLICATIONS

PCT International Search Report and Written Opinion of International Application No. PCT/US2011/000949 (date of mailing Sep. 20, 2011—10 pages).

*Primary Examiner* — Walter D. Griffin
*Assistant Examiner* — Timothy Cleveland
(74) *Attorney, Agent, or Firm* — Renner, Kenner, Greive, Bobak, Taylor & Weber

(57) ABSTRACT

A food mixing machine (16) includes an agitator (15) for mixing food in a cup (C). The cup (C) is received in a flexible boot (22) which is carried by a cup holder (21). The cup holder (21) also carries a cup release assembly (23) which is biased away from the cup by springs (24). At the end of the mixing cycle, a release initiating assembly (60) engages the cup release assembly (23) which overcomes the bias of the springs (24) and allows the cup release assembly (23) to engage the boot (22) which in turn releases the cup (C) from the cup holder (21).

13 Claims, 6 Drawing Sheets

APPARATUS FOR RELEASING A CUP FROM THE CUP HOLDER OF A FOOD MIXING MACHINE

TECHNICAL FIELD

This invention relates to a machine which mixes food products in a cup. More particularly, this invention relates to a cup holding assembly for such a machine. More specifically, this invention relates to a cup holding assembly which automatically releases the cup when the mixing process is completed.

BACKGROUND ART

Many establishments, such as fast food restaurants or the like, mix food products, such as blending condiments into soft serve ice creams, smoothies or the like, directly in the cup to be used by the customer to consume the product. It is a time saving advantage if such machines are fully automated. In such situations, the cup is filled with the products to be blended and is placed in a cup holder. Upon activation of the machine, the cup holder can rotate and can move upwardly to allow an agitator to be received in the cup and mix the products contained therein. The cup holder then moves downwardly to the home position and the machine is deactivated so that the cup can be removed from the cup holder with the food product therein being mixed and ready for consumption.

In some situations a problem could arise in that the full cup would be difficult to remove from the cup holder. While the cup can be pulled loose with a sufficient amount of force, such often spills contents from the cup creating a mess in the machine which would have to be cleaned by the attendant.

The need exists, therefore, for a system of releasing a cup from the cup holder of a food mixing machine.

DISCLOSURE OF THE INVENTION

It is thus an object of one aspect of the present invention to provide a food mixing machine with a cup holding assembly that releases the cup when the mixing process is completed.

It is an object of another aspect of the present invention to provide a cup holding assembly, as above, which releases the cup without damage thereto and without spillage of the contents of the cup.

These and other objects of the present invention, as well as the advantages thereof over existing prior art forms, which will become apparent from the description to follow, are accomplished by the improvements hereinafter described and claimed.

In general, a machine for mixing food in a cup includes a cup holder adapted to receive the cup therein. A cup release assembly is positioned within the cup holder and is biased away from the cup. A release initiating assembly is positioned to overcome the bias and allow the cup release assembly to dislodge it from the cup holder.

A preferred exemplary system for releasing a cup from the cup holder of a food mixing machine according to the concepts of the present invention is shown by way of example in the accompanying drawings without attempting to show all the various forms and modifications in which the invention might be embodied, the invention being measured by the appended claims and not by the details of the specification.

PREFERRED EMBODIMENT FOR CARRYING OUT THE INVENTION

Figure 1:
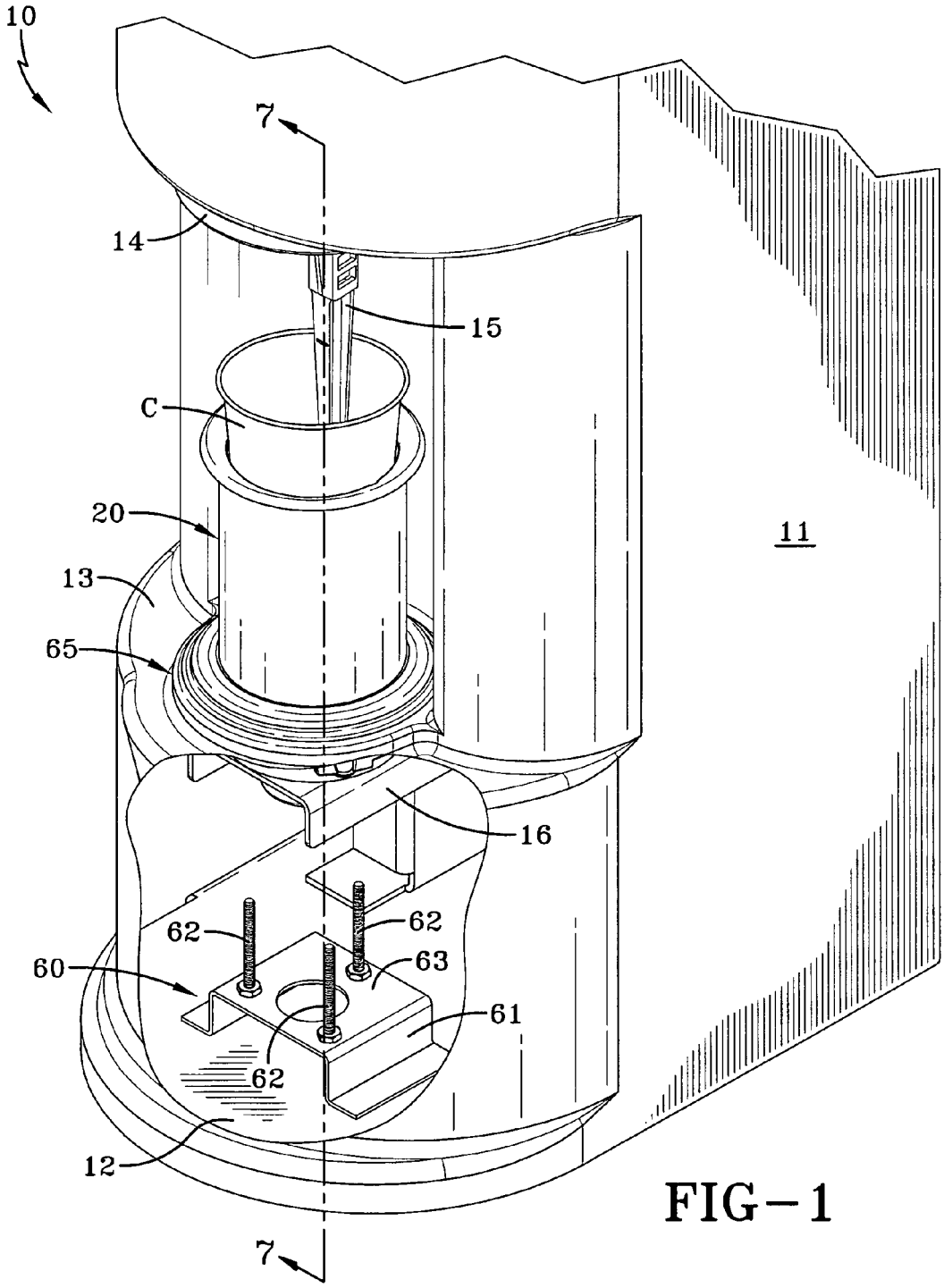
FIG. 1 is a somewhat schematic fragmented representation of a food mixing machine having the cup holding assembly of the present invention.
Figure 7:
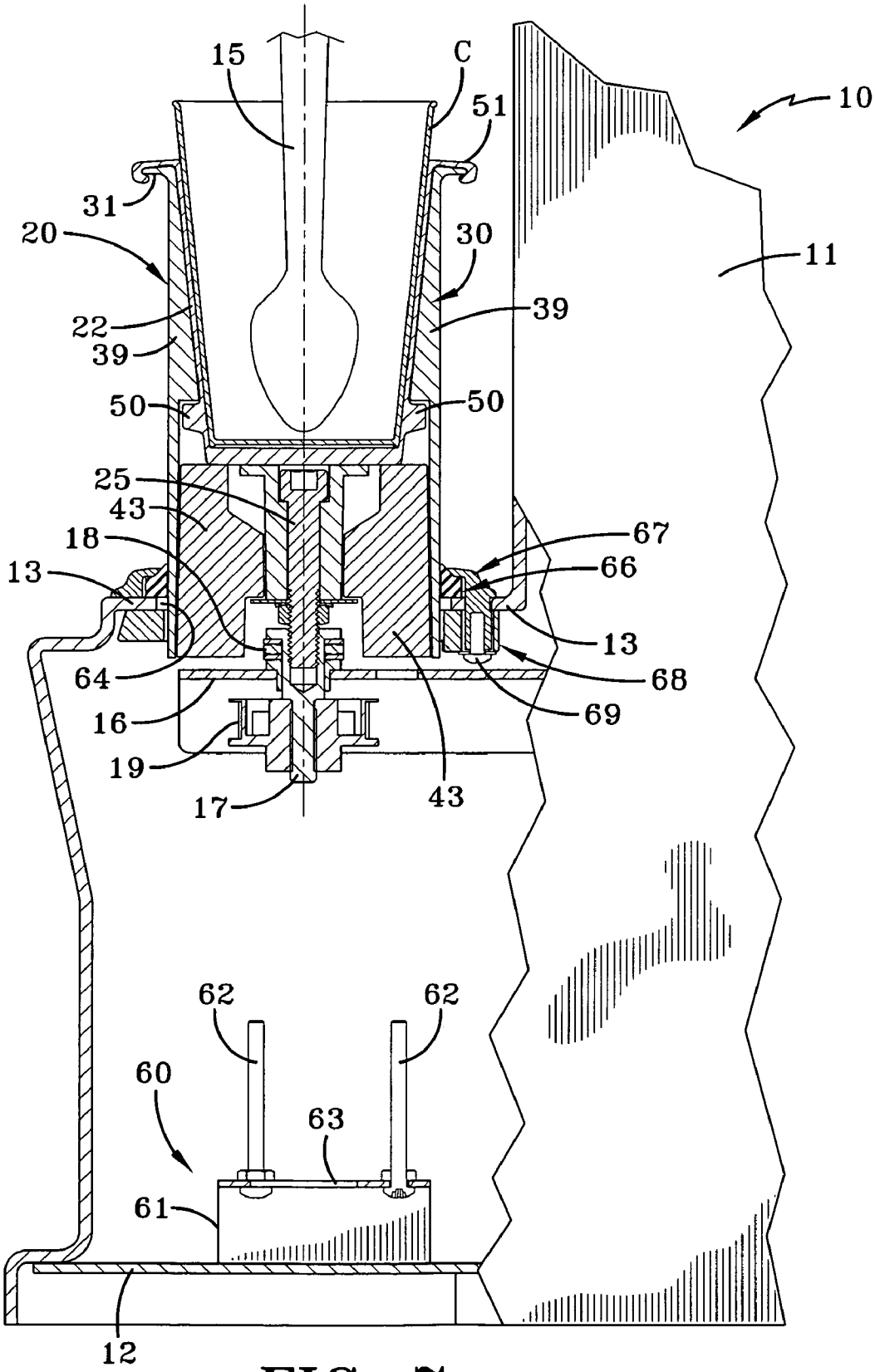
FIG. 7 is a sectional view taken substantially along line 7-7 of FIG. 1.
Figure 8:
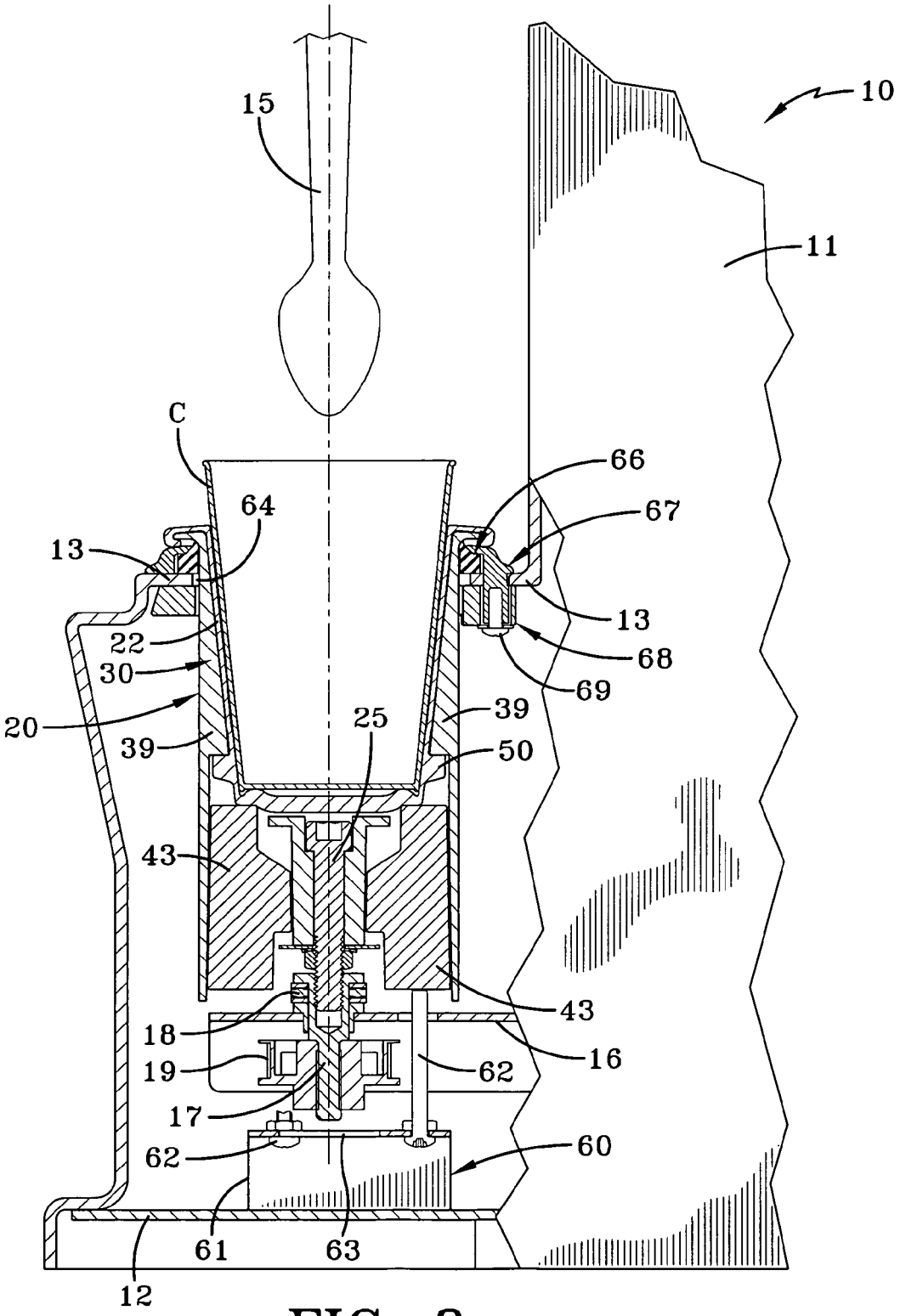
FIG. 8 is a sectional view like FIG. 7 but showing the cup being released from the cup holding assembly.

A food mixing machine is somewhat schematically shown in FIG. 1 and is indicated generally by the numeral 10. Machine 10 includes a housing 11 which covers the components of the machine and which includes a lower platform 12, an intermediate platform 13 and an upper platform 14. An agitator 15, shown to be in the configuration of a spoon, extends downwardly from upper platform 14 and is rotated by a motor (not shown) carried by one of the platforms. Agitator 15 is designed to mix food products in a cup C. A travel plate 16 is moveable upwardly and downwardly by a motor (not shown) carried by one of the platforms. As shown in FIGS. 7 and 8, travel plate 16 also carries a shaft 17, bearings 18 and a pulley 19 which is driven by a motor (not shown) carried by one of the platforms, as will hereinafter be described in more detail. Reference is made to U.S. patent application Ser. No. 12/460,273 filed Jul. 17, 2009 for whatever details are necessary for the complete understanding of a typical machine 10 and its operation.

Figure 2:
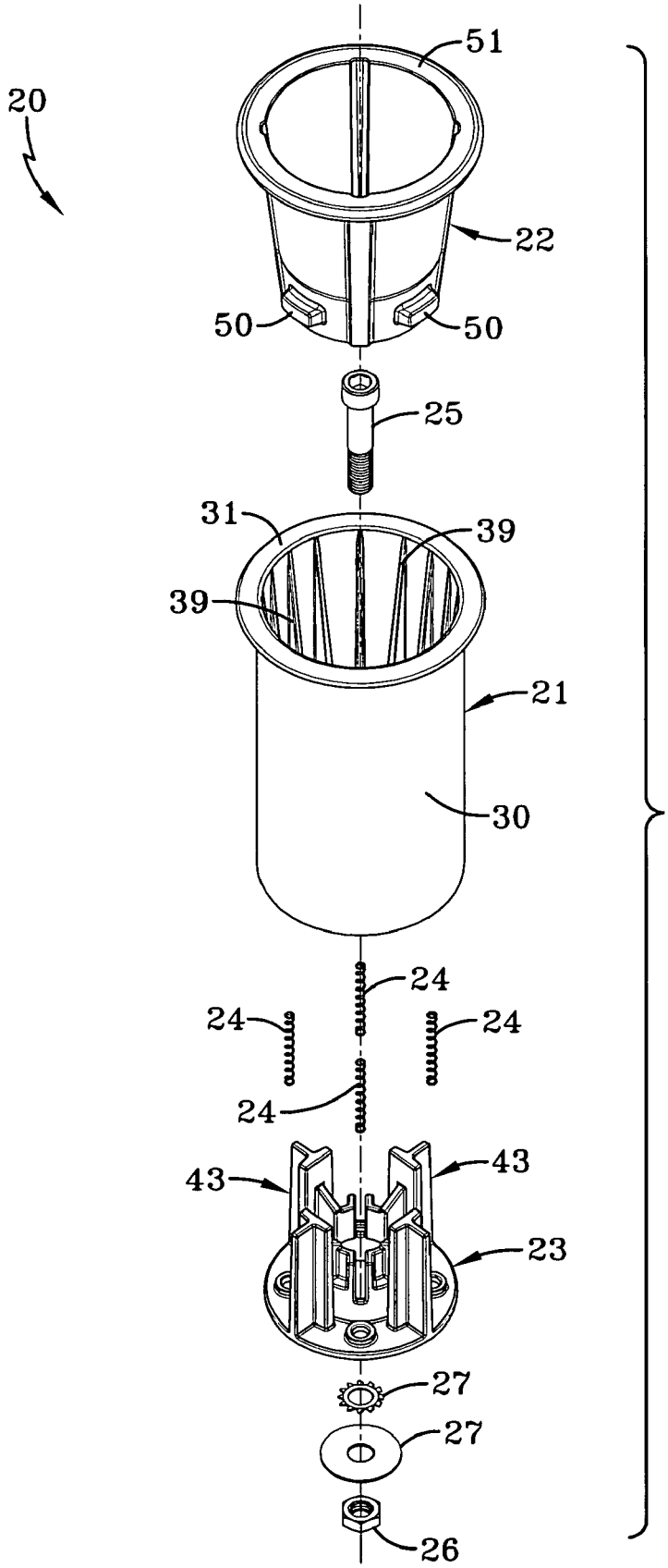
FIG. 2 is a top perspective exploded view of the components of the cup holding assembly.

Travel plate 16 carries a cup holding assembly generally indicated by the numeral 20. The basic components of cup holding assembly 20 are shown in FIG. 2 and include a cup holder generally indicated by the numeral 21 and made of a rigid plastic material, a flexible boot 22 made of a rubber-like material, and a cup release assembly generally indicated by the numeral 23. As will hereinafter be described in more detail, cup holder assembly also includes a plurality of springs 24 and its components are held together by a bolt 25 which receives a nut 26 and washers 27.

Figure 3:
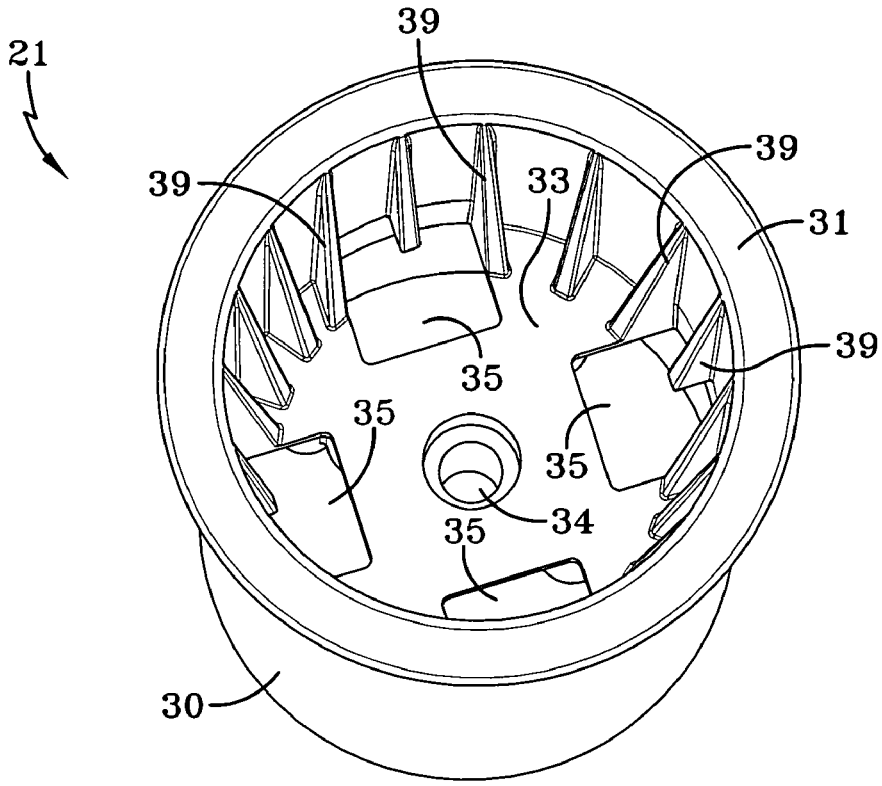
FIG. 3 is a top perspective view of the cup holder component of the cup holding assembly.
Figure 4:
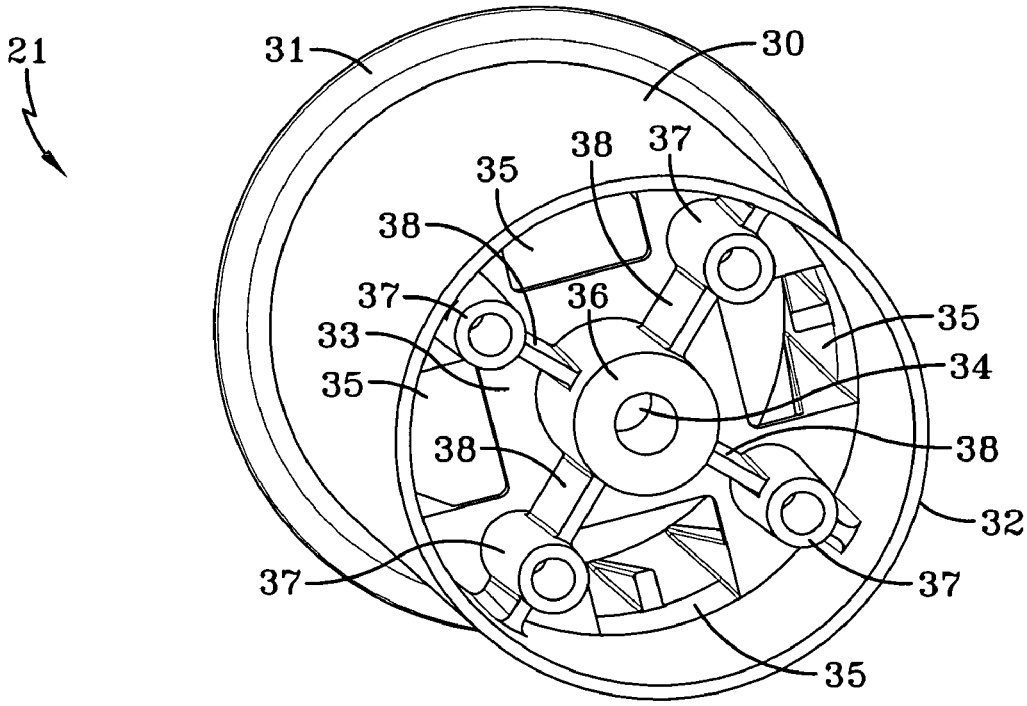
FIG. 4 is a bottom perspective view of the cup holder component of the cup holding assembly.

The construction of cup holder 21 is best shown in FIGS. 3 and 4 and includes a generally cylindrical sidewall 30 being open at its top, where a flange 31 is formed, and open at its bottom 32. A shelf 33 is formed near the open bottom 32 and includes a central aperture 34. Four slots 35 are formed at the periphery of shelf 33 and are spaced ninety degrees of each other. A boss 36 is formed under central aperture 34 of shelf 33. In addition, socket bosses 37 are formed on the bottom of shelf 33 and are positioned radially outward of boss 36 by ribs 38. Triangular shaped ribs 39 are also circumferentially spaced along the inside of sidewall 30 to provide strength to cup holder 21 as well as to assist in the engagement of boot 22 as will be hereinafter described.

Figure 5:
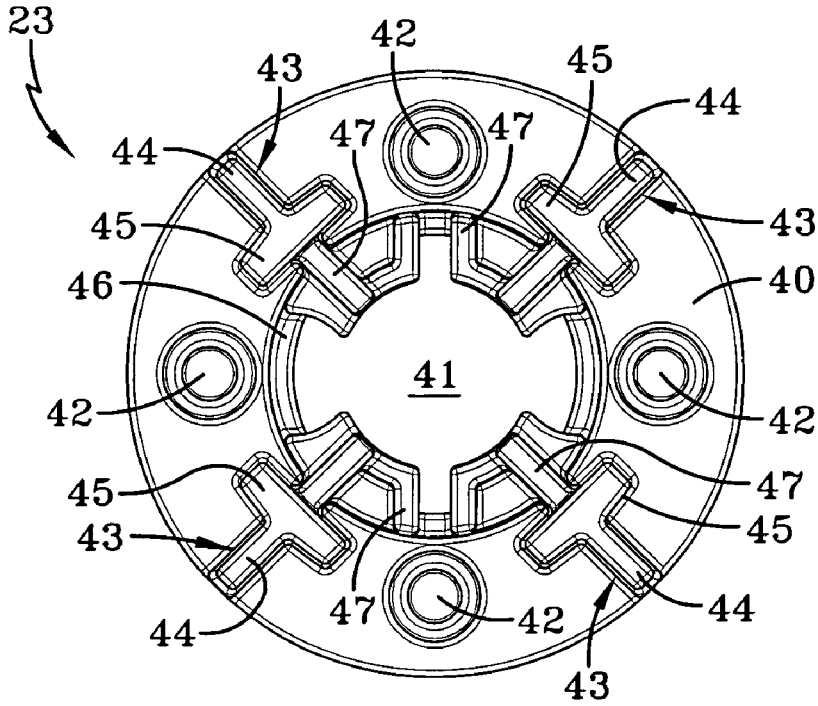
FIG. 5 is a top plan view of the cup releasing component of the cup holding assembly.
Figure 6:
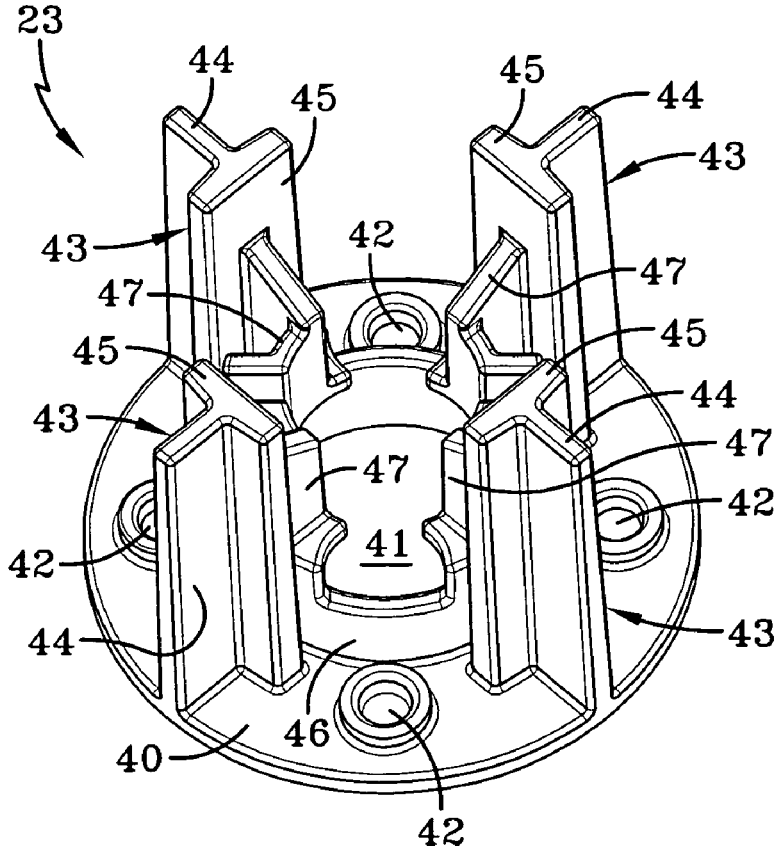
FIG. 6 is a perspective view of the cup releasing component of the cup holding assembly.

Cup release assembly 23 is best shown in FIGS. 5 and 6 and includes a base plate 40 having a central aperture 41 and circumferentially spaced sockets 42 positioned radically outward of aperture 41. As will hereinafter be described in more detail, sockets 42 are positioned so as to be alignable with bosses 37 of cup holder 21. A plurality of towers, generally indicated by the numeral 43, extend upwardly from base plate 40 at positions generally equally circumferentially between sockets 42. Each tower 43 is T-shaped having a base portion 44 and an upper branch portion 45. A hub 46 extends upwardly from the periphery of central aperture 41, and a network of ribbing 47 extends from hub 46 to each branch portion 45 of towers 43. Ribbing 47 thus provides structural strength and stability to towers 43.

Cup release assembly 23 and cup holder 21 are assembled by positioning release assembly 23 into the bottom of cup holder 21 with towers 43 aligned with slots 35 of cup holder 21, and with sockets 42 aligned with bosses 37. Springs 24 are positioned in sockets 42 and bosses 37 as the parts are assembled such that cup release assembly 23 is moveable relative to cup holder 21. Bolt 25 is inserted through central aperture 34 of cup holder 21 and through aperture 41 of cup release assembly and is held in place by nut 26. As shown in FIGS. 7 and 8, bolt 25 may also be used to connect cup holding assembly 20 to travel plate 16. As a result, cup holder 21 and cup release assembly 23 are attached, but cup release assembly 23 may be moved relative to cup holder 21 as will be hereinafter described.

In order to mix food, a cup C or other container is placed in cup holding assembly 20. While it may be placed directly into cup holder 21, preferably it is positioned into boot 22 which is, in turn, carried by cup holder 21. To that end, boot 22 is shaped like the inside of cup holder 21 and includes lugs 50 formed on the side thereof. As best seen in FIGS. 7 and 8, lugs 50 are received under the ribs 39 of cup holder 31 at the area of slots 35 to hold boot 32 in place. Also, boot 32 is provided with an upper peripheral lip 51 that engages the top flange 31 of cup holder 21. The presence of boot 22 protects the cup from any possible damage which could be caused by towers 43 during the cup releasing process, now to be described, and the presence of flexible boot 32 also accommodates cups of slightly varying sizes.

When travel plate 16 is in the up position as shown in FIG. 1 and more particularly in FIG. 7, food is being mixed in cup C by the rotating agitator 15. At the same time cup holding assembly 20 is being rotated on shaft 17 with cup C secured within boot 22. However, when travel plate 16 moves downwardly to the FIG. 8 position, indicative of the mixing process being completed, cup release assembly 23 is activated by a release initiating assembly generally indicated by the numeral 60 and now to be described.

As best shown in FIG. 1, release initiating assembly 60 includes a bracket 61 which is attached to lower platform 12. Bracket 61 carries a plurality of upstanding posts 62 which are shown to be in the form of screws threaded onto the upper surface 63 of bracket 61. As travel plate 16 approaches the FIG. 8 position, posts 62 will contact the base plate 40 of cup release assembly 23. Such overcomes the bias of springs 24 and allows cup release assembly 23 to move relative to cup holder 21. As such, towers 43 move upwardly through slots 35 of cup holder 21 and branch portions 45 push on the bottom of boot 22 to slightly deform the same as shown in FIG. 8. Such action dislodges cup C from boot 22 and allows the user to easily remove cup C from cup holding assembly 20.

When the cup holding assembly 20 is moving upwardly and downwardly, it is passing through an opening 64 (FIGS. 7 and 8) formed in intermediate platform 13 or an equivalent area of housing 11. Opening 64 thus provides access to the machine components that are located below it which is basically those components that may be on lower platform 12. Since food drippings could often accumulate on and otherwise run down the outside of cup holder 21 and potentially pass through opening 64, a seal assembly, generally indicated by the numeral 65 is provided.

Seal assembly 65 includes an elastomeric gasket 66 which is carried between an upper plastic ring generally indicated by the numeral 67, and a lower plastic ring generally indicated by the numeral 68. Rings 67 and 68 may be held together by fasteners 69. As more fully described in pending U.S. patent application Ser. No. 12/661,399, filed Mar. 16, 2010, to which reference is made for a complete understanding of seal assembly 65, seal assembly thus assures that food drippings or other contaminants do not pass through opening 64.

In view of the foregoing, it should be evident that a food mixing machine constructed as described herein substantially improves the art and otherwise accomplishes the objects of the present invention.

What is claimed is:

1. A machine for mixing food in a cup comprising a cup holder adapted to receive the cup therein, a rotatable agitator adapted to be received in said cup to mix the food, a cup release assembly biased away from the cup, and a release initiating assembly positioned to overcome the bias and allow said cup release assembly to dislodge the cup from said cup holder.

2. The machine of claim 1 wherein said cup release assembly is positioned within said cup holder.

3. The machine of claim 2 wherein said cup holder includes a shelf, the cup being received on one side of said shelf and said cup release assembly being positioned on the other side of said shelf.

4. The machine of claim 3, said shelf having slots therein and said cup release assembly having towers aligned with said slots, said towers passing through said slots and engaging the cup upon operation of said release initiating assembly.

5. The machine of claim 4 wherein each said tower is T-shaped having a base and an orthogonal branch, each said branch engaging the cup.

6. A machine for mixing food in a cup comprising a cup holder adapted to receive the cup therein, a rotatable agitator adapted to be received in said cup to mix the food, a cup release assembly, at least one spring positioned between said cup holder and said cup release assembly to bias said cup release assembly away from the cup, and a release initiating assembly positioned to overcome the bias and allow said cup release assembly to dislodge the cup from said cup holder.

7. The machine of claim 6, said cup release assembly including a base plate holding said at least one spring.

8. The machine of claim 7 wherein said release initiating assembly includes at least one post to engage said base plate and compress said spring.

9. The machine of claim 7, said base plate having at least one socket to receive said at least one spring.

10. The machine of claim 9 wherein said cup holder includes a shelf having at least one socket to receive said at least one spring.

11. A machine for mixing food in a cup comprising a cup holder, a rotatable agitator adapted to be received in said cup to mix the food, a flexible boot received in said cup holder and adapted to receive the cup, a cup release assembly biased away from the cup, and a release initiating assembly positioned to overcome the bias and allow said cup release assembly to engage the cup through said flexible boot to dislodge the cup from said cup holder.

12. The machine of claim 11 wherein said cup holder has a generally cylindrical sidewall the interior of which is provided with ribs.

13. The machine of claim 12 wherein said flexible boot has a generally cylindrical sidewall with at least one lug extending outwardly therefrom, said lug being engaged by said ribs to hold said flexible boot in said cup holder.

* * * * *